US006279628B1

(12) United States Patent
Chang

(10) Patent No.: US 6,279,628 B1
(45) Date of Patent: Aug. 28, 2001

(54) WOOD PLANING MACHINE WITH IMPROVEMENT RELATING TO A THICKNESS ADJUSTMENT DEVICE

(75) Inventor: Chiu-Tsun Chang, Taichung (TW)

(73) Assignee: P & F Brother Industrial Corporation, Taichung (TW)

( * ) Notice: Subject to any disclaimer, the term of this patent is extended or adjusted under 35 U.S.C. 154(b) by 0 days.

(21) Appl. No.: 09/687,545

(22) Filed: Oct. 13, 2000

(51) Int. Cl.[7] ..... B27C 1/00

(52) U.S. Cl. ..... 144/130; 33/642; 33/791; 83/522.19; 144/117.1; 144/373; 409/210

(58) Field of Search ..... 33/626, 640, 642, 33/700, 710, 791, 792; 83/522.11, 522.15, 522.19; 144/114.1, 117.1, 129, 130, 373; 409/210, 214, 218, 220

(56) References Cited

U.S. PATENT DOCUMENTS

| | | | | |
|---|---|---|---|---|
| 2,520,868 | * | 8/1950 | Whiting | 451/9 |
| 2,658,424 | * | 11/1953 | Huck | 409/210 |
| 3,067,788 | * | 12/1962 | Eschenburg | 144/129 |
| 3,718,168 | * | 2/1973 | Berends | 144/129 |
| 5,795,113 | * | 8/1998 | Wixey et al. | 83/522.19 X |
| 5,927,357 | * | 7/1999 | Welsh et al. | 144/130 |
| 5,957,174 | * | 9/1999 | Shadeck | 144/130 |
| 6,076,573 | * | 6/2000 | Welsh et al. | 144/130 |
| 6,089,287 | * | 7/2000 | Welsh et al. | 144/130 |
| 6,131,628 | * | 10/2000 | Chiang | 144/130 |

* cited by examiner

*Primary Examiner*—W. Donald Bray
(74) *Attorney, Agent, or Firm*—Townsend and Townsend and Crew LLP

(57) ABSTRACT

A wood planing machine includes left and right pairs of posts fixed uprightly at left and right mounting sides of a machine base. A cutter carriage is disposed above the machine base, and has opposite end portions mounted respectively, vertically and movably on the posts. A cutter unit is disposed on the carriage. A carriage locking mechanism locks the cutter carriage at a selected height relative to the machine base. A thickness adjustment device is mounted on the cutter carriage for adjusting thickness to be removed from a workpiece by the cutter unit, and includes a pointer-retaining case that is fixed on the cutter carriage, and that is formed with a vertical row of positioning groove units, a vertical measuring disposed on the pointer-retaining case, and a vertical stop shaft. The shaft extends rotatably and is mounted vertically and movably on the pointer-retaining case, and has a lower contact end abutting against the machine base. A horizontal scale pointer is disposed within the pointer-retaining case, and is fastened securely to the stop shaft for synchronous movement therewith.

7 Claims, 9 Drawing Sheets

WOOD PLANING MACHINE WITH IMPROVEMENT RELATING TO A THICKNESS ADJUSTMENT DEVICE

BACKGROUND OF THE INVENTION

1. Field of the Invention

The invention relates to a wood planing machine, more particularly to a wood planing machine with improvement relating to a thickness adjustment device.

2. Description of the Related Art

Referring to FIGS. 1 and 2, a conventional wood planing machine is shown to include an elongated machine base 10, left and right pairs of posts 13, vertical left and right threaded rods 16, a cutter carriage 12, a cutter unit (not visible), a carriage locking mechanism, and a thickness adjustment device.

As illustrated, the machine base 10 has a top surface, opposed left and right mounting sides 101 spaced apart from each other in a longitudinal direction, and opposed feed-in and take-out sides disposed apart from each other in a transverse direction.

The left and right pairs of posts 13 are fixed on the top surface of the machine base 10 at the left and right mounting sides 101, respectively.

The cutter carriage 12 is disposed above the machine base 10, and has opposite end portions mounted respectively, vertically and movably on the left and right pairs of posts 13.

The left and right threaded rods 16 (only the latter is visible in FIG. 2) are mounted respectively and rotatably on the left and right mounting sides 101 of the machine base 10 such that the threaded rods 16 are disposed respectively between the left and right pairs of posts 13, and extend threadedly through the end portions of the cutter carriage 12 for moving the cutter carriage 12 along the posts 13 when the threaded rods 16 rotate on the machine base 10, thereby adjusting height of the cutter carriage 12.

The cutter unit (not visible) is disposed on the cutter carriage 12 in a known manner for cutting a workpiece 100 fed therebelow in the transverse direction.

The carriage locking mechanism locks the cutter carriage 12 at a selected height.

The thickness adjustment device includes a rotary disc 14 rotatably mounted on the machine base 10 at the right mounting side 101, and formed with three vertical stems 141 of different lengths, and a horizontal shaft-holding arm 150 fixed on the right end portion of the cutter carriage 12, and a vertical stop shaft 15 fastened threadedly to the shaft-holding arm 150 on the cutter carriage 12 in such a manner that rotation of the rotary disc 14 can result in alignment of a selected one of the vertical stems 141 with the stop shaft 15, thereby determining a thickness to be removed from the workpiece 100 by the cutter unit 12.

However, the aforesaid conventional wood planing machine provides restricted thickness adjustment since there are only three vertical stems 141 on the rotary disc 14, thereby adversely affecting the adjustment range.

SUMMARY OF THE INVENTION

Therefore, the object of this invention is to provide a wood planing machine with an improved thickness adjustment device which is clear of the aforementioned drawback.

Accordingly, a wood planing machine of the present invention includes an elongated machine base, left and right pairs of posts, a cutter carriage, vertical left and right threaded rods, a cutter unit, a carriage locking mechanism, and a thickness adjustment device. The machine base has a top surface, opposed left and right mounting sides spaced apart from each other in a longitudinal direction, and opposed feed-in and take-out sides disposed apart from each other in a transverse direction. The left and right pairs of posts are fixed on the top surface of the machine base at the left and right mounting sides, respectively. The cutter carriage is disposed above the machine base, and has opposite end portions mounted respectively, vertically and movably on the posts. The left and right threaded rods are mounted respectively and rotatably on the left and right mounting sides of the machine base such that the threaded rods are disposed respectively between the left and right pairs of posts, and extend threadedly through the end portions of the cutter carriage for moving the cutter carriage along the posts when the threaded rods rotate on the machine base, thereby adjusting height of the cutter carriage. The cutter unit is disposed rotatably on the cutter carriage. The carriage locking mechanism locks the cutter carriage at a selected height relative to the machine base. The thickness adjustment device is mounted on the cutter carriage, and is adapted to adjust thickness to be removed from a workpiece by the cutter unit. The adjustment device includes a pointer-retaining case, a vertical measuring scale, a vertical stop shaft, a horizontal scale pointer, and a biasing spring. The pointer-retaining case is fixed on the cutter carriage, and is formed with a vertical row of positioning groove units. The vertical measuring scale is disposed on the pointer-retaining case. The stop shaft extends rotatably and is mounted vertically and movably on the pointer-retaining case, and has a lower contact end abutting against the machine base. The horizontal scale pointer is disposed within the pointer-retaining case, and is fastened securely to the stop shaft for synchronous movement therewith. The scale pointer has an inner section, an outer section that is directed toward the scale and that is adapted to indicate the thickness to be removed from the workpiece by the cutter unit, and an intermediate section between the inner and outer sections. The biasing spring is associated with the stop shaft, and biases the stop shaft to rotate about a vertical axis in a direction such that the scale pointer engages a selected one of the positioning groove units in the pointer-retaining case so as to arrest vertical movement of the stop shaft on the pointer-retaining case.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
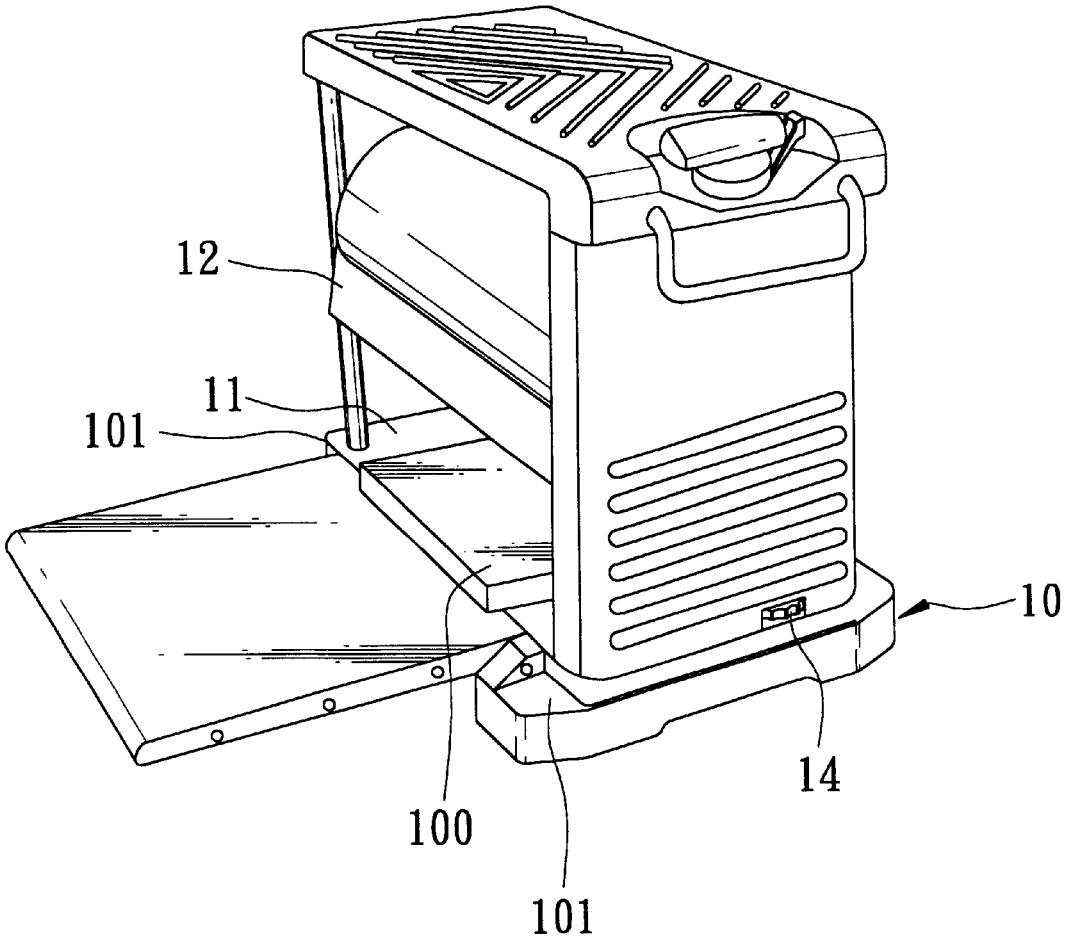
FIG. 1 PRIOR ART
FIG. 1 is a perspective view of a conventional wood planing machine incorporating a thickness adjustment device therein.
Figure 2:
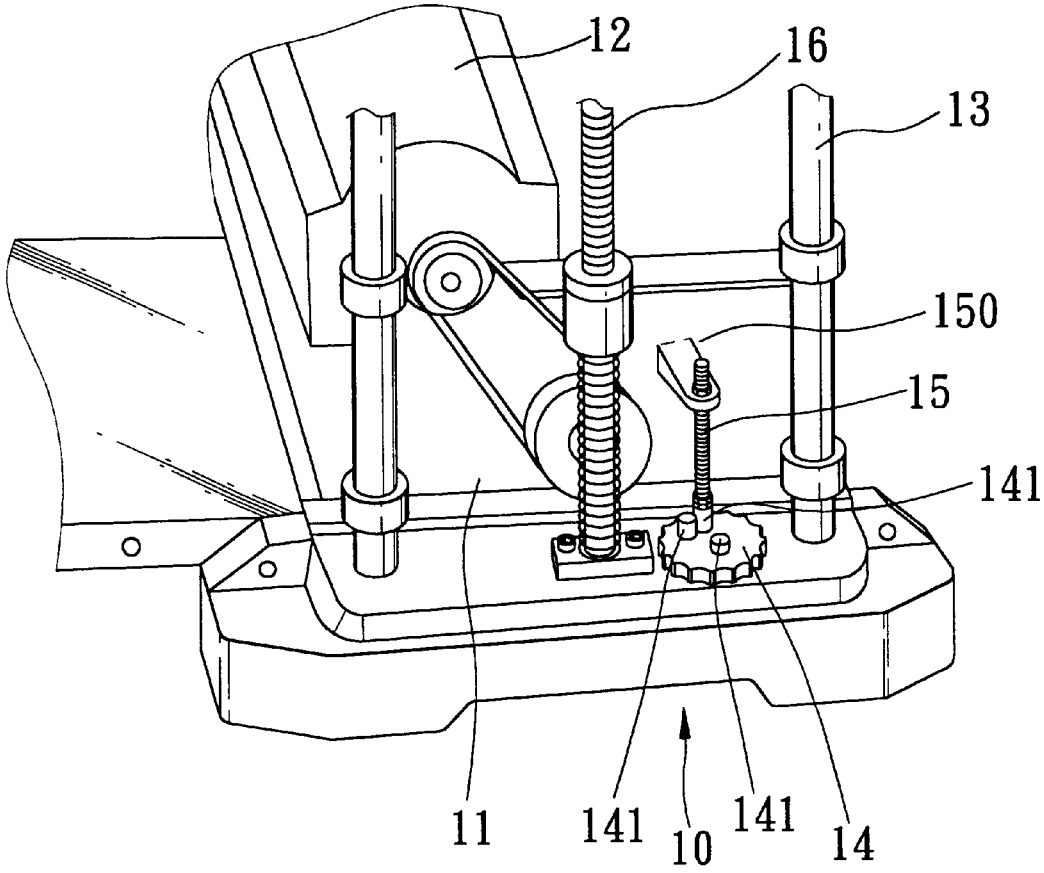
FIG. 2 PRIOR ART
FIG. 2 is a fragmentary perspective view of the conventional wood planing machine, illustrating how the thickness adjustment device is mounted on a cutter carriage for adjusting thickness to be removed from a workpiece by a cutter unit.
Figure 3:
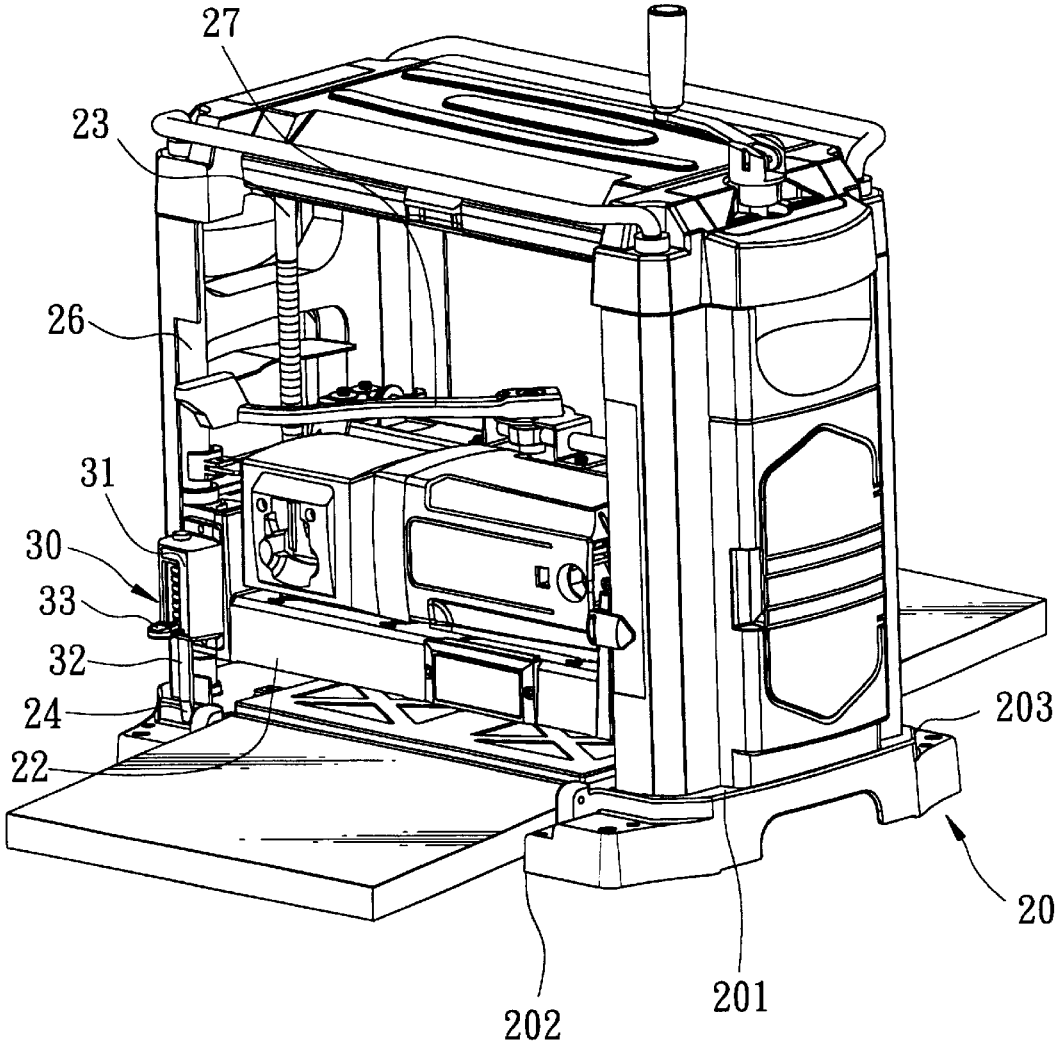
FIG. 3 is a perspective view of a preferred embodiment of a wood planing machine of the present invention.
Figure 4:
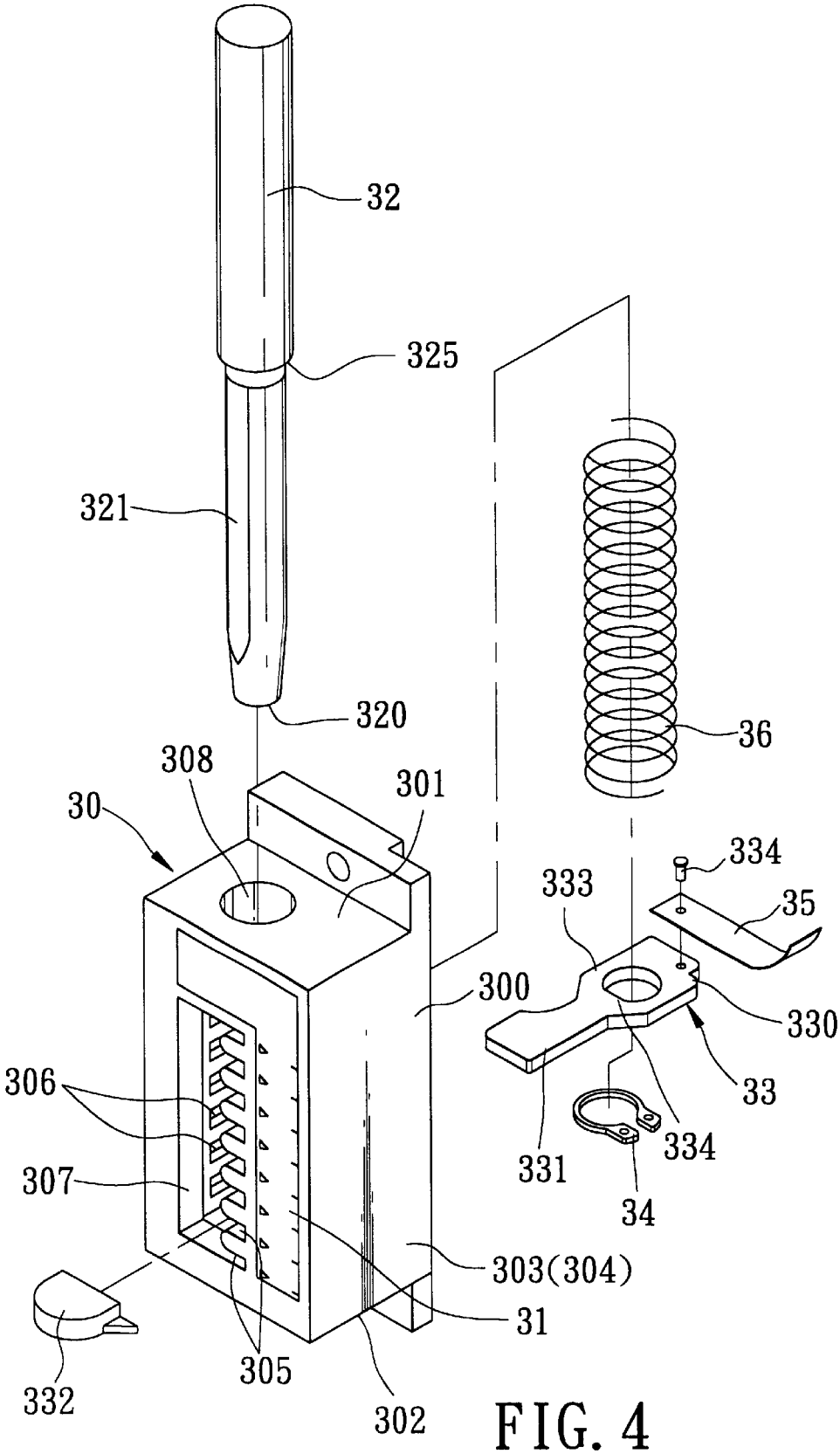
FIG. 4 is an exploded view of a thickness adjustment device employed in the preferred embodiment.
Figure 5:
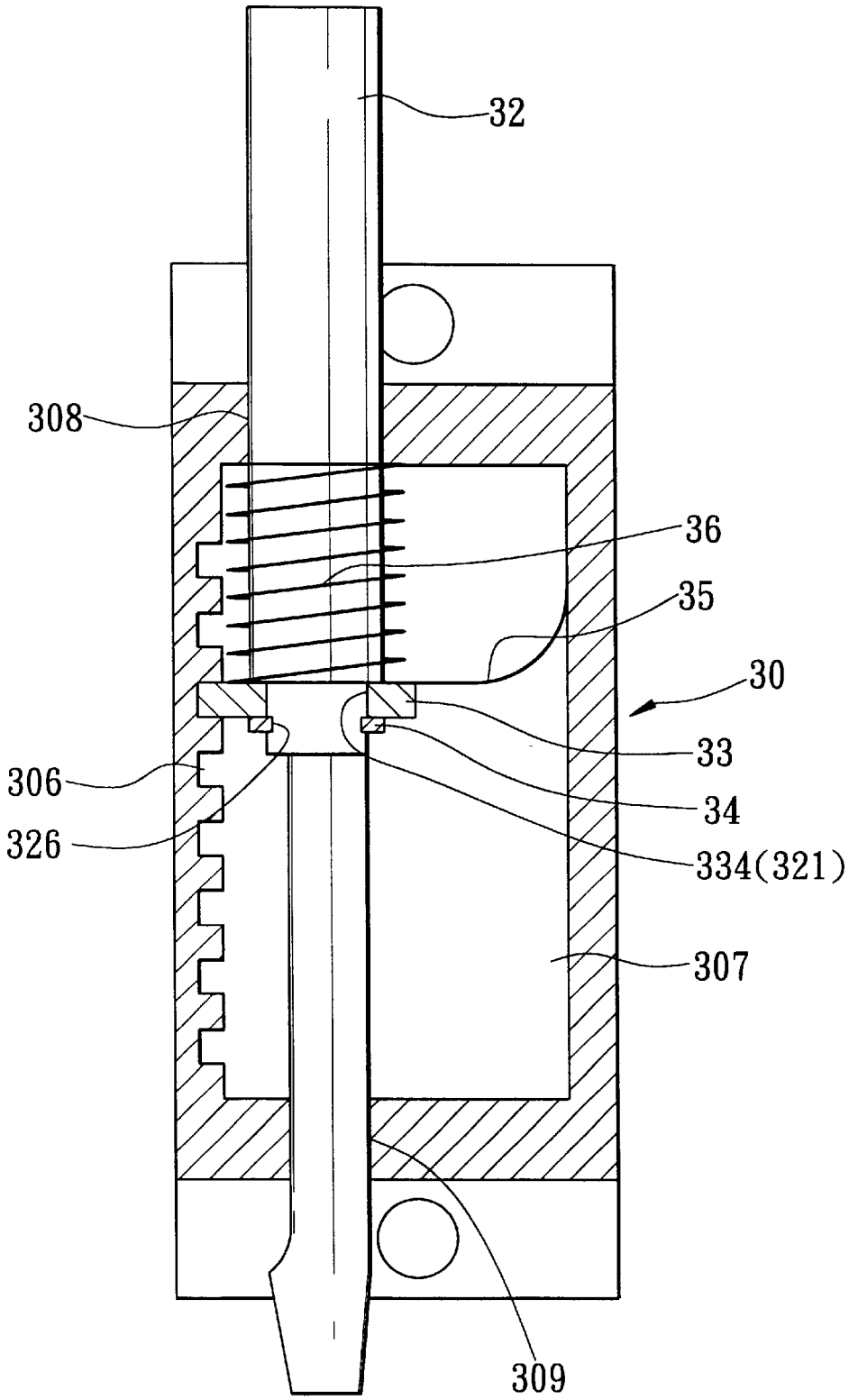
FIG. 5 is a sectional view of the thickness adjustment device employed in the preferred embodiment.
Figure 6:
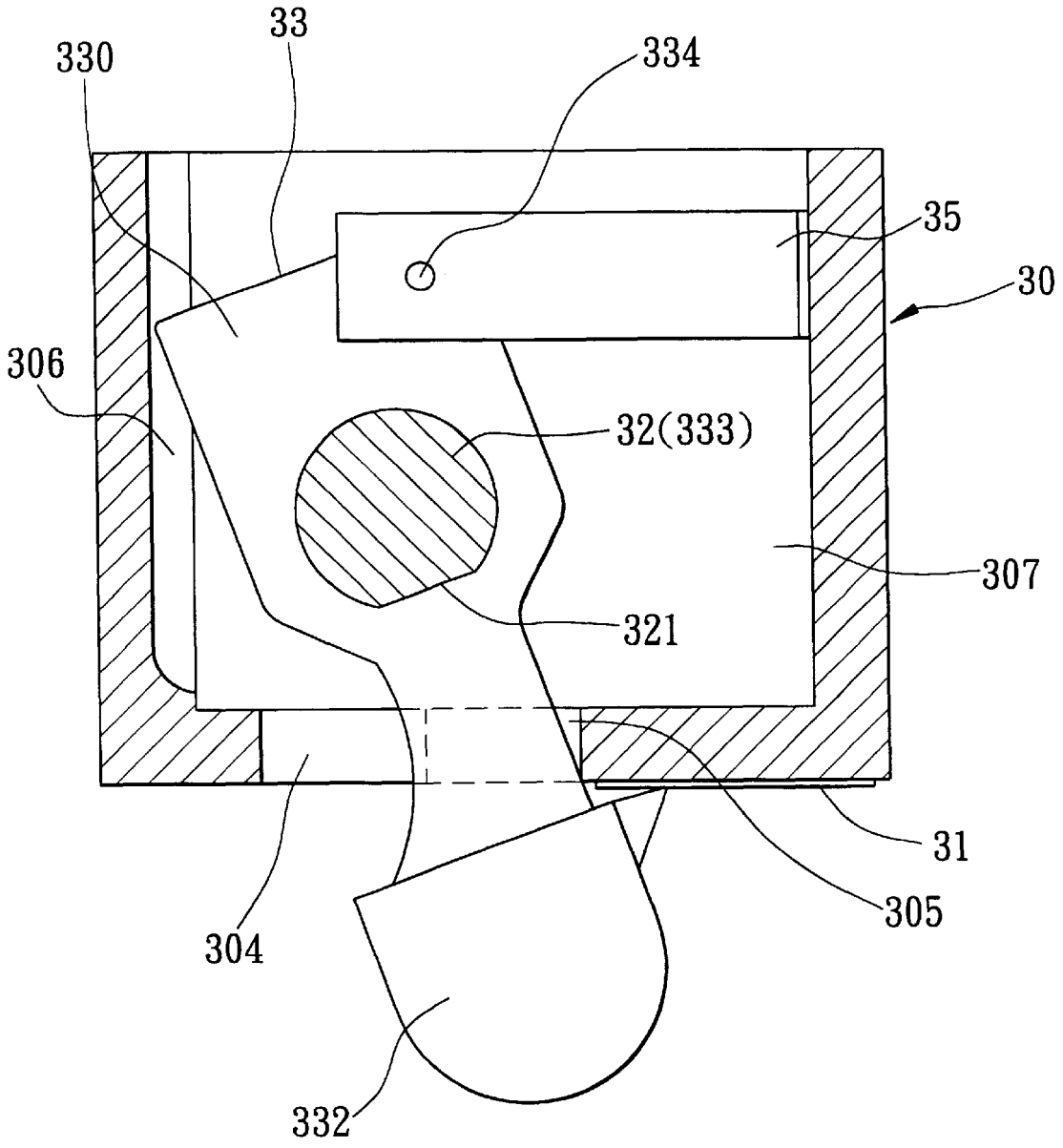
FIG. 6 is a sectional top view of the thickness adjustment device shown in FIG. 5.

Referring to FIGS. 3 to 6, the preferred embodiment of a wood planing machine of the present invention is shown to include an elongated machine base 20, left and right pairs of posts 26, a cutter carriage 22, vertical left and right threaded rods 23, a cutter unit, a carriage locking mechanism 27, and a thickness adjustment device 30.

As illustrated, the machine base 20 has a top surface, opposed left and right mounting sides 201 spaced apart from each other in a longitudinal direction, and opposed feed-in and take-out sides 202,203 disposed apart from each other in a transverse direction.

The left and right pairs of posts 26 are fixed on the top surface of the machine base 20 at the left and right mounting sides 201, respectively.

The cutter carriage 22 is disposed above the machine base 20, and has opposite end portions mounted respectively, vertically and movably on the left and right pairs of posts 26.

The vertical left and right threaded rods 23 (only one is visible in FIG. 3) are mounted respectively and rotatably on the left and right mounting sides 201 of the machine base 20 such that the threaded rods 23 are disposed respectively between the left and right pairs of posts 26, and extend threadedly through the end portions of the cutter carriage 22 for moving the cutter carriage 22 along the posts 26 when the threaded rods 23 rotate on the machine base 20, thereby adjusting the height of the cutter carriage 22.

The cutter unit (not visible) is disposed on the cutter carriage 22.

The carriage locking mechanism 27 locks the cutter carriage 22 at a selected height. Since the structures of the carriage locking mechanism 27 and the cutter unit are not pertinent to the present invention, a detailed description of the same is omitted herein for the sake of brevity.

The thickness adjustment device 30 is mounted on the cutter carriage 22, and is adapted to adjust thickness to be removed from a workpiece 100" (see FIG. 7) by the cutter unit. The thickness adjustment device 30 includes a rectangular pointer-retaining case 300, a vertical measuring scale 31, a vertical stop shaft 32, a horizontal scale pointer 33, and a biasing spring 35. The pointer-retaining case 300 is fixed on the cutter carriage 22 at the feed-in side 202 of the machine base 20, and is formed with a vertical row of positioning groove units. The vertical measuring scale 31 is disposed on the pointer-retaining case 300. The vertical stop shaft 32 extends rotatably and is mounted vertically and movably on the pointer-retaining case 300, and has a lower contact end 320 projecting downwardly from a lowermost end of the cutter carriage 22 to abut against the machine base 20. The horizontal scale pointer 33 is disposed within the pointer-retaining case 300, and is fastened securely to the stop shaft 32 for synchronous movement therewith. The scale pointer 33 has an inner section 330, an outer section 331 that is directed toward the scale 31 and that is adapted to indicate the thickness to be removed from the workpiece 100" (see FIG. 7) by the cutter unit, and an intermediate section 333 between the inner and outer sections 330,331 and provided with a fixed indicating element 332. The biasing spring 35 is associated with the stop shaft 32, and biases the stop shaft 32 to rotate about a vertical axis in a direction such that the scale pointer 33 engages a selected one of the positioning groove units in the pointer-retaining case 300 so as to arrest vertical movement of the stop shaft 32 on the pointer-retaining case 300.

In the preferred embodiment, the pointer-retaining case 300 includes a horizontal upper plate 301, a horizontal lower plate 302, and vertical left and right plates 303,304 interposed between the upper and lower plates 301,302 to define a scale-pointer receiving space 307 within which the scale pointer 33 is disposed such that the outer section 331 of the indicating element 332 projects outwardly of the receiving space 307. The upper and lower plates 301,302 of the pointer-retaining case 300 define respectively upper and lower shaft-extension holes 308,309 that are in communication with the receiving space 307, and that permit extension of the stop shaft 32 therethrough.

The positioning groove units include a vertical row of left grooves 306 that is formed in the left plate 304, and a vertical row of right grooves 305 that is formed in the right plate 303. The inner and intermediate sections 330,333 of the scale pointer 33 are biased by the biasing spring 35 to engage respectively one of the left grooves 306 and one of the right grooves 305.

The intermediate section 333 of the scale pointer 33 has a generally semi-circular retention hole 334 formed therethrough. The stop shaft 32 has a shoulder 325, an intermediate portion 321 of a generally semi-circular cross section that engages fittingly the retention hole 334 in the scale pointer 33 so as to rotate synchronously therewith, and an annular groove 326 (see FIG. 5) formed in the intermediate section 321.

The thickness adjustment device 30 further includes a C-shaped retaining ring 34 that engages the annular groove 326 in the stop shaft 32 so as to clamp the scale indicator 33 between the shoulder 325 and the C-shaped retaining ring 34, thereby preventing movement of the scale pointer 33 on the stop shaft 32.

A compression spring 36 is disposed within the receiving space 307 of the pointer-retaining case 300 around the stop shaft 32, and has an upper end fixed to the upper plate 301 of the pointer-retaining case 300, and a lower end fixed on the scale pointer 33 for biasing the scale pointer 33 downward within the pointer-retaining case 300.

Preferably, the biasing spring 35 is shaped as an elongated reed spring which is connected pivotally to the inner section 330 of the scale pointer 33 at one end by means of a rivet 334, and which presses against the right plate 303 of the pointer-retaining case 300 at the other end so as to bias the inner section 330 of the scale pointer 33 to turn away from the right plate 303. An upright support stem 24 is fixed on the machine base 20, and has a top end flush with the top surface of the machine base 20.

Figure 7:
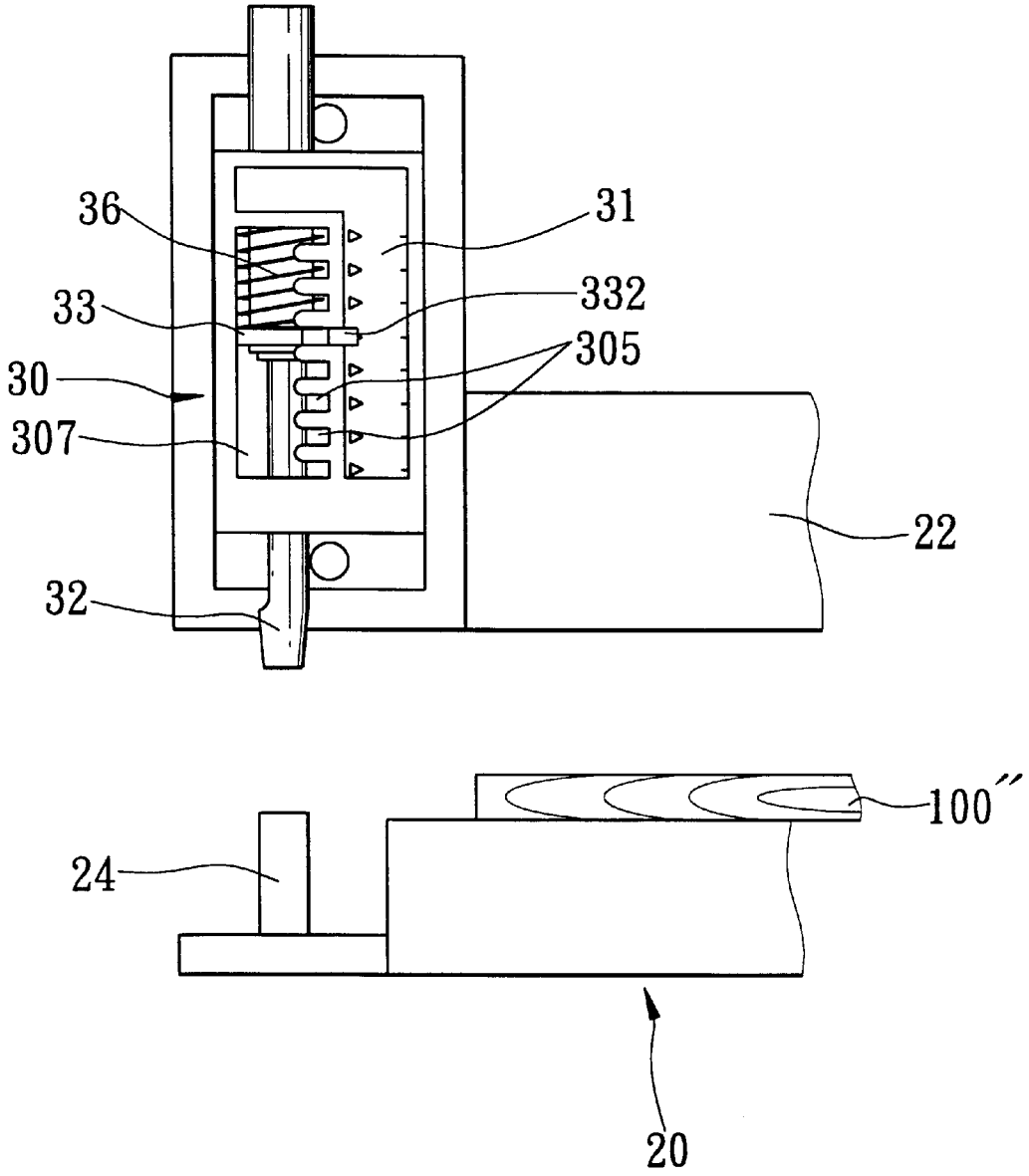
FIG. 7 illustrates how the thickness adjustment device is adjusted relative to the machine base in the preferred embodiment.
Figure 8:
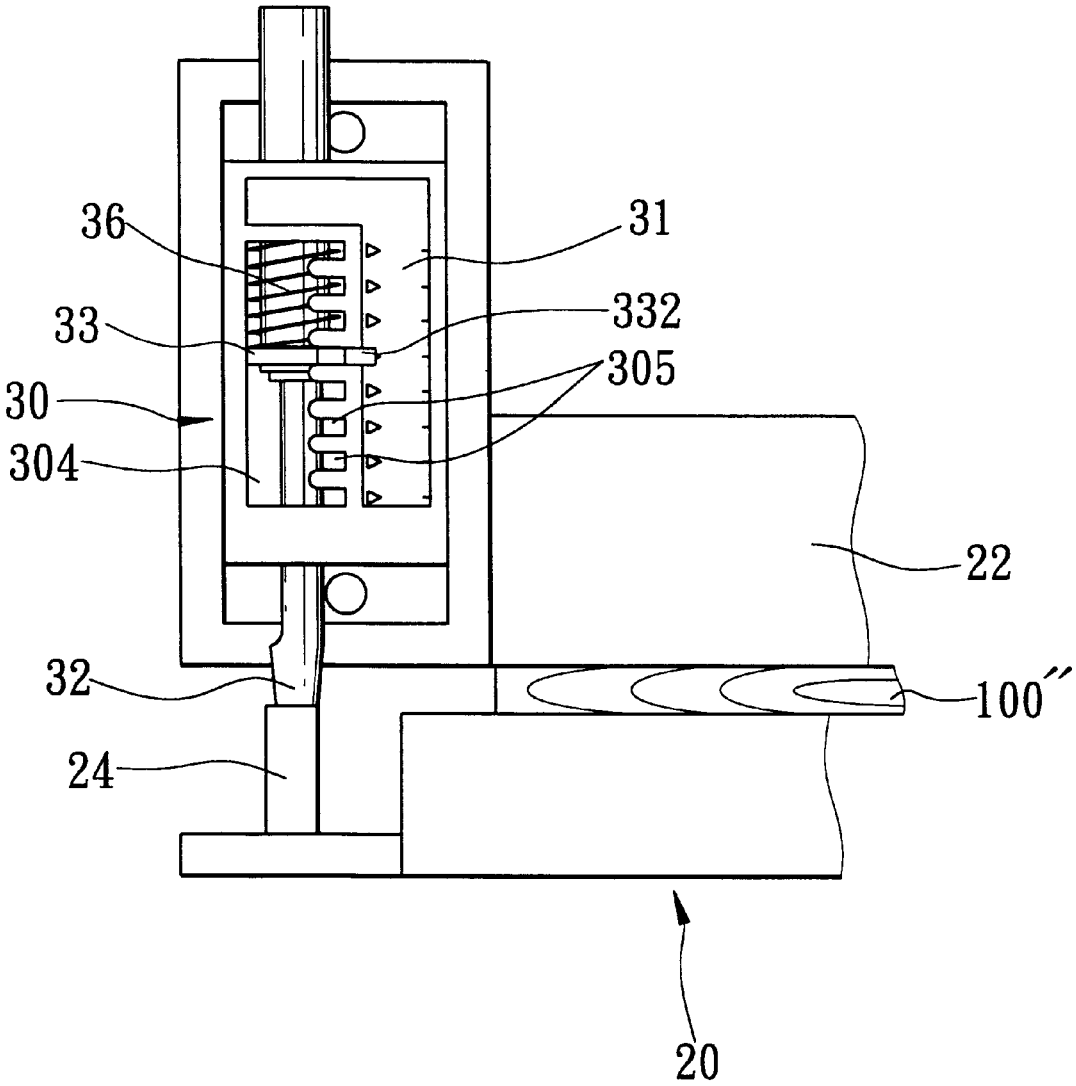
FIGS. 8 and 9 respectively show two positions of the thickness adjustment device of the preferred embodiment, illustrating how two different thicknesses of two different workpieces are removed by the cutter unit of the preferred embodiment.

FIGS. 7 and 8 illustrates how the stop shaft 32 is adjusted in order to remove a large thickness from the workpiece 100" during operation of the cutter unit. When it is desired to adjust the thickness to be removed from the workpiece 100", an external force is applied on the scale pointer 33 to rotate the stop shaft 32 about the vertical axis against biasing action of the reed spring 35 until the inner and intermediate sections 330,333 of the scale pointer 33 are disengaged from the left and right grooves 306,305. Under this condition, the stop shaft 32 can be moved vertically on the pointer-retaining case 300 for adjustment to a desired height. Removal of the external force from the scale pointer 33 will result in engagement of the inner and intermediate sections 330, 333 in the desired left and right grooves 306,305 of the pointer retaining case 300 by the action of the spring 35.

Figure 9:
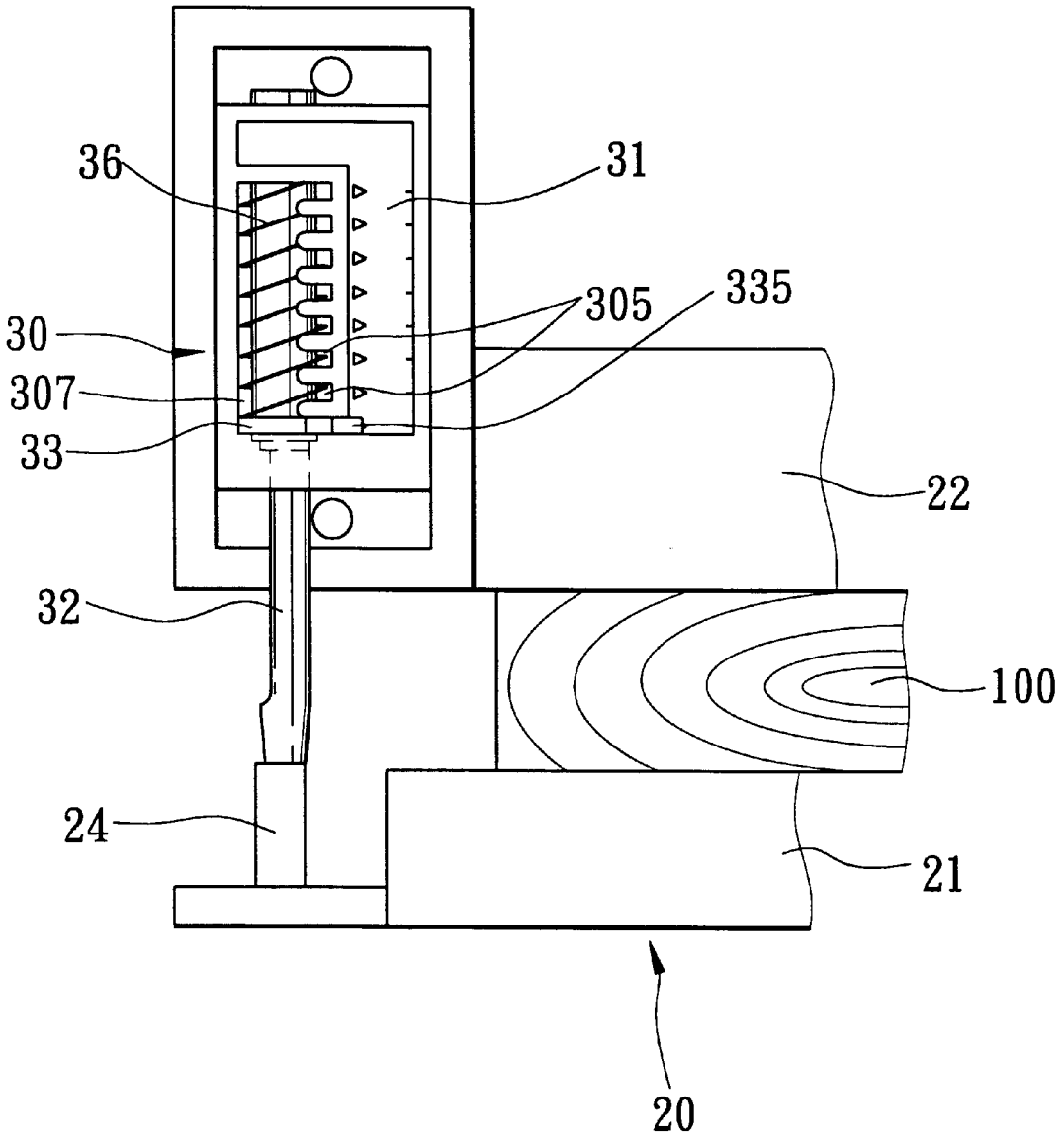

FIG. 9 illustrates how the stop shaft 32 is adjusted relative to the pointer-retaining case 300 in order to remove a small amount of thickness from the workpiece 100". The operation is generally the same as that described beforehand and will not be detailed further for the sake of brevity.

With this invention thus explained, it is apparent that numerous modifications and variations can be made without departing from the scope and spirit of this invention. It is therefore intended that this invention be limited only as indicated in the appended claims.

I claim:

1. A wood planing machine comprising:

a machine base having a top surface, opposed left and right mounting sides spaced apart from each other in a longitudinal direction, and opposed feed-in and take-out sides disposed apart from each other in a transverse direction;

left and right pairs of posts fixed on said top surface of said machine base at said left and right mounting sides, respectively;

a cutter carriage disposed above said machine base, and having opposite end portions mounted respectively, vertically and movably on said left and right pairs of posts;

vertical left and right threaded rods mounted respectively and rotatably on said left and right mounting sides of said machine base such that said threaded rods are disposed respectively between said left and right pairs of posts and extend threadedly through said end portions of said cutter carriage for moving said cutter carriage along said posts when said threaded rods rotate on said machine base, thereby adjusting height of said cutter carriage;

a cutter unit disposed on said cutter carriage;

a carriage locking mechanism for locking said cutter carriage at a selected height; and a thickness adjustment device mounted on said cutter carriage and adapted to adjust thickness to be removed from a workpiece by said cutter unit, said thickness adjustment device including a pointer-retaining case fixed on said cutter carriage and formed with a vertical row of positioning groove units, a vertical measuring scale disposed on said pointer-retaining case, a vertical stop shaft extending rotatably and mounted vertically and movably on said pointer-retaining case, and having a lower contact end abutting against said machine base, a horizontal scale pointer disposed within said pointer-retaining case and fastened securely to said stop shaft for synchronous movement therewith, said scale pointer having an inner section, an outer section that is directed toward said scale and that is adapted to indicate the thickness to be removed from the workpiece by said cutter unit, and an intermediate section between said inner and outer sections, and a biasing spring associated with said stop shaft and biasing said stop shaft to rotate about a vertical axis in a direction such that said scale pointer engages a selected one of said positioning groove units in said pointer-retaining case so as to arrest vertical movement of said stop shaft on said pointer-retaining case.

2. The wood planing machine as defined in claim 1, wherein said pointer-retaining case includes a horizontal upper plate, a horizontal lower plate, and vertical left and right plates interposed between said upper and lower plates to define a scale-pointer receiving space within which said scale pointer is disposed such that said outer section of said scale pointer projects outwardly of said receiving space, said upper and lower plates of said pointer-retaining case defining respectively upper and lower shaft-extension holes that are in communication with said receiving space and that permit extension of said stop shaft therethrough.

3. The wood planing machine as defined in claim 2, wherein said positioning groove units include a vertical row of left grooves that is formed in said left plate, and a vertical row of right grooves that is formed in said right plate, said inner and intermediate sections of said scale pointer being biased by said biasing spring to engage respectively one of said left grooves and one of said right grooves.

4. The wood planing machine as defined in claim 3, wherein said intermediate section of said scale pointer has a generally semi-circular retention hole formed therethrough, said stop shaft having a shoulder, an intermediate portion of a generally semi-circular cross section engaging fittingly said retention hole in said scale pointer so as to rotate synchronously therewith, and an annular groove formed in said intermediate section, said thickness adjustment device further including a C-shaped retaining ring that engages said annular groove so as to clamp said scale indicator between said shoulder and said C-shaped retaining ring, thereby preventing movement of said scale pointer on said stop shaft.

5. The wood planing machine as defined in claim 4, further comprising a compression spring disposed within said receiving space of said pointer-retaining case around said stop shaft, and having an upper end fixed to said upper plate of said pointer-retaining case, and a lower end fixed on said scale pointer for biasing said scale pointer downward within said case.

6. The wood planing machine as defined in claim 3, wherein said biasing spring is shaped as an elongated reed spring which is connected pivotally to said inner section of said scale pointer at one end and which presses against said right plate at the other end so as to bias said inner section of said scale pointer to turn away from said right plate.

7. The wood planing machine as defined in claim 1, wherein said thickness adjustment device is disposed at said feed-in side of said machine base.

* * * * *